United States Patent [19]

Seki et al.

[11] Patent Number: 5,040,395

[45] Date of Patent: Aug. 20, 1991

[54] LOOPER CONTROL SYSTEM FOR CONTINUOUS ROLLING MILL

[75] Inventors: Yoshiro Seki, Tokyo; Kunio Sekiguchi, Kawagoe; Toshihiro Koyama, Saitama, all of Japan

[73] Assignee: Kabushiki Kaisha Toshiba, Kawasaki, Japan

[21] Appl. No.: 475,915

[22] Filed: Feb. 6, 1990

[30] Foreign Application Priority Data

Feb. 7, 1989 [JP] Japan ..... 1-27886

[51] Int. Cl.[5] ..... B21B 37/06

[52] U.S. Cl. ..... 72/8; 72/11; 72/17; 72/19; 72/21

[58] Field of Search ..... 72/8, 10, 17, 18, 205, 72/9, 11, 19, 21

[56] References Cited

U.S. PATENT DOCUMENTS 4,507,946 4/1985 Koyama et al. ..... 72/17

FOREIGN PATENT DOCUMENTS 58-86919 5/1983 Japan .
59-118213 7/1984 Japan .
59-118214 7/1984 Japan .
0166312 9/1984 Japan ..... 72/17
59-44129 10/1984 Japan .
0040923 2/1987 Japan ..... 72/17
0296905 12/1987 Japan ..... 72/18
0224809 9/1988 Japan ..... 72/17
0224810 9/1988 Japan ..... 72/17
0299808 12/1988 Japan ..... 72/17

OTHER PUBLICATIONS

Y. Seki et al., "Optimal Multivariable Looper Control for Hot Strip Finishing Mill", 1988 IEEE Industry Applications Society Annual Meeting, IEEE Catalog No. 88CH2565-0, Oct., 1988, pp. 1201-1206.

*Primary Examiner*—Lowell A. Larson
*Assistant Examiner*—Thomas C. Schoeffler
*Attorney, Agent, or Firm*—Foley & Lardner

[57] ABSTRACT

There is disclosed a looper control system for a continuous rolling mill comprising: a section for performing the integral operation of respective deviations between measured values and target values with respect to the tension and the looper angle, and the proportional operation of respective deviations between the tension, the looper operation angle, and the rotational speed of the looper motor at the time of start of the control and those at the present time to synthesize values thus obtained to deliver them to the looper current control unit or the looper control unit, a section for performing the integral operation and the proportional operation similar to the above to synthesize the values thus obtained to deliver them to the main motor speed control unit; and an optimum gain setting unit for correcting respective proportional gains in dependency upon the speed of the main motor. The system may additionally have a section for altering the optimum gain by the fact that the tension is extreme and/or the looper angle is extreme.

3 Claims, 6 Drawing Sheets

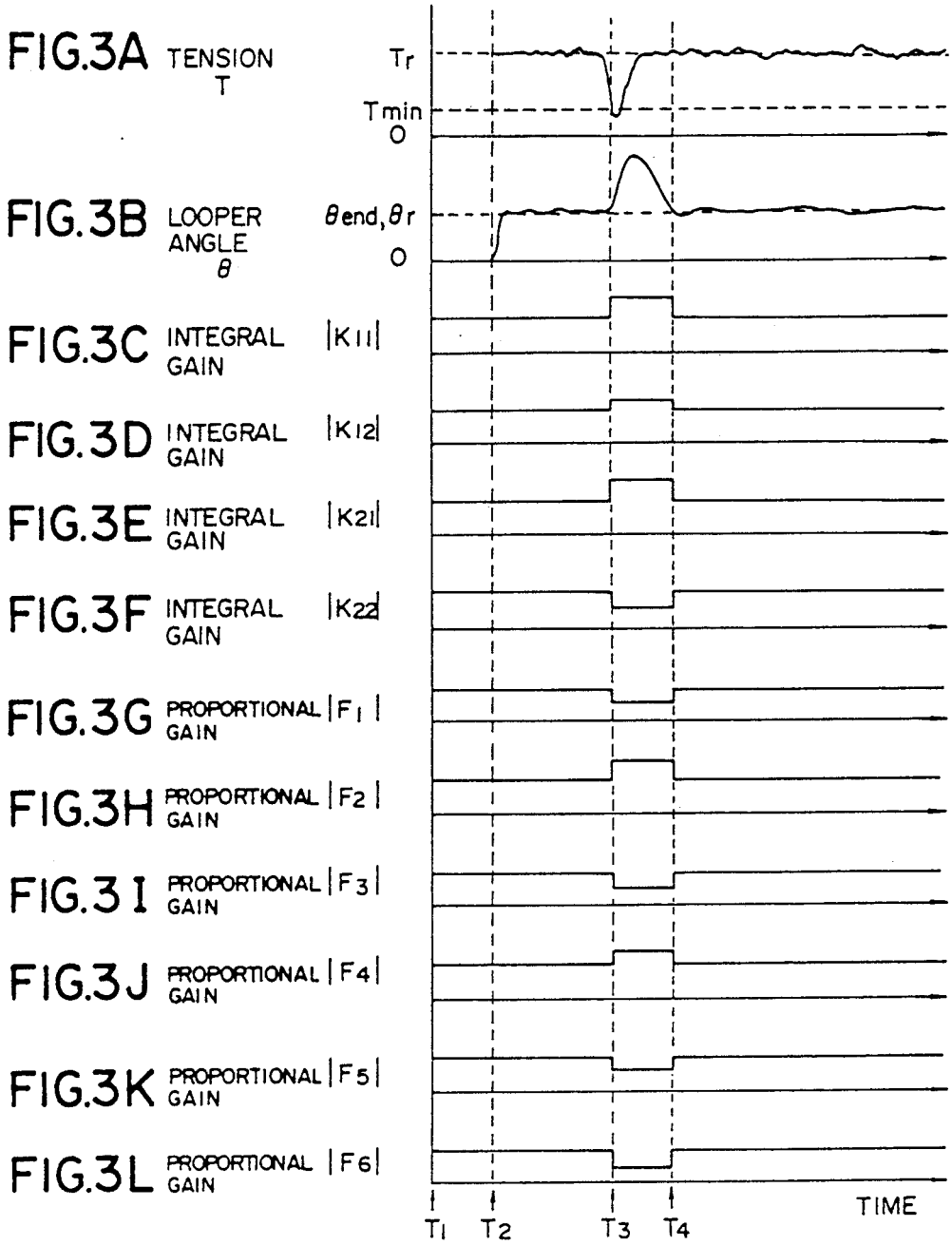
FIG.3A TENSION T
Tr
Tmin
0
FIG.3B LOOPER ANGLE θ
θend, θr
0
FIG.3C INTEGRAL GAIN |K11|
FIG.3D INTEGRAL GAIN |K12|
FIG.3E INTEGRAL GAIN |K21|
FIG.3F INTEGRAL GAIN |K22|
FIG.3G PROPORTIONAL GAIN |F1|
FIG.3H PROPORTIONAL GAIN |F2|
FIG.3I PROPORTIONAL GAIN |F3|
FIG.3J PROPORTIONAL GAIN |F4|
FIG.3K PROPORTIONAL GAIN |F5|
FIG.3L PROPORTIONAL GAIN |F6|
T1
T2
T3
T4
TIME

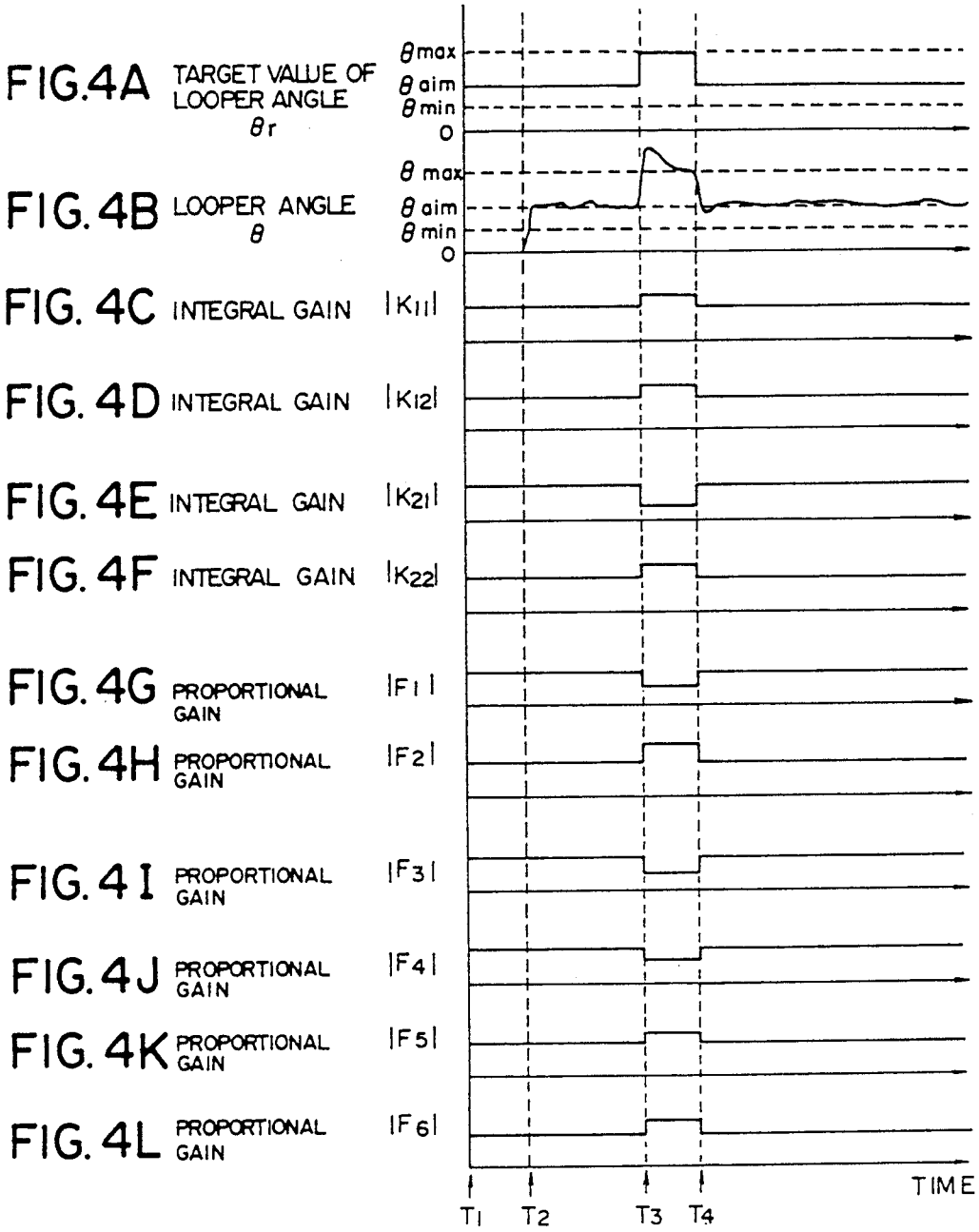
FIG.4A TARGET VALUE OF LOOPER ANGLE θr
θmax
θaim
θmin
0
FIG.4B LOOPER ANGLE θ
θmax
θaim
θmin
0
FIG. 4C INTEGRAL GAIN |K11|
FIG. 4D INTEGRAL GAIN |K12|
FIG. 4E INTEGRAL GAIN |K21|
FIG. 4F INTEGRAL GAIN |K22|
FIG. 4G PROPORTIONAL GAIN |F1|
FIG. 4H PROPORTIONAL GAIN |F2|
FIG. 4I PROPORTIONAL GAIN |F3|
FIG. 4J PROPORTIONAL GAIN |F4|
FIG. 4K PROPORTIONAL GAIN |F5|
FIG. 4L PROPORTIONAL GAIN |F6|
TIME
T1
T2
T3
T4

LOOPER CONTROL SYSTEM FOR CONTINUOUS ROLLING MILL

BACKGROUND OF THE INVENTION

This invention relates to a looper control system for controlling the looper operational angle and the tension between stands in a continuous rolling mill.

In a continuous rolling mill, as the important element for evaluating the quality of products, there are thickness, width, crown, and flatness of strips. Since the value of the tension between stands exerts a large influence on these elements, it is desirable to keep it constant as far as possible. For this reason, in the hot continuous rolling mill, such control is conducted to absorb changes in the tension value by looper mechanisms provided between respective rolling mill stands.

Hitherto, in a looper control system for a continuous rolling mill provided with loopers between stands, the tension between stands, i.e., interstand tension is controlled by allowing the looper drive motor to generate a predetermined torque, and by changing the difference between interstand speeds of the main motor, to adjust the looper operational angle. However, with this system, the length of material between stands is changed by modifying the speeds of the main motor nearby the looper. As a result, the looper operational angle control is carried out following the change in the strip length between stands. Accordingly, this leads to the drawback that the interstand tension fluctuation caused by the looper operational angle control becomes large.

Further, when a control for looper operational angle is carried out in order to reduce such a tension fluctuation, the response in the looper operational angle control must be lowered, resulting in the drawback that the control cannot cope with high frequency disturbances.

On the other hand, in order to solve the above-mentioned problems, as a looper control system to which the optimum control theory is applied, there have been proposed systems, such as, for example, disclosed in the Japanese Patent Publication No. 44129/84, the Japanese Patent Applications Laid Open Nos. 86919/83, 18213/84, 118214/84.

Japanese Patent Publication No. 44129/84 is directed to a system constructed to handle, as the state variable in the optimum control theory, looper operational angular velocity, looper operational angle, tension between stands, and difference between interstand material speeds, thus, to constitute a feedback based on only the proportional operation. However, where there is steadily a relatively large disturbance, or where the target tension changes with time, any offset is produced because there is no integral term, and results in lowered controllability. In an extreme case, a break in the strip results.

The Japanese Patent Laid Open No. 86919/83 is directed to a system constructed to add the integrating operation to the technique disclosed in the Japanese Patent Publication No. 44129/84 to thereby set a reference value by itself and remove the above-mentioned offset.

In these systems disclosed in the Japanese Patent Publication No. 44129/84 and the Japanese Patent Application Laid Open No. 86919/83, the proportional operation for deviation in connection with the reference value of the Taylor expansion used when linearly approximating the controlled system is performed. Accordingly, there remain problems to be solved, such as, for example, it is necessary to input this reference value when actually carrying out a control, working stability is poor because the proportional operational components appear to a great extent at the time of the start of control where the deviation from the reference value is large, and the like.

In the Japanese Patent Laid Open No. 118213/84, with a view to solving this problem, there is proposed a looper control system in a form to reconsider the control model from the standpoint of integral-type optimum regulator theory and perform the integral operation by integrating a deviation from the target value with respect to the variable having a control target value, and to perform the proportional operation with respect to the deviation from a lock-on value (a value at the time of start of control) subject to the proportional operation.

In addition, to Japanese Patent Application Laid Open No. 118214/84 is directed to a system to employ the looper drive motor rotational speed control in place of the looper drive motor current control unit in the configuration of Japanese Patent Application Laid Open No. 118213/84 and thereby provide an improved stability of the looper operational angle.

However, when an attempt is made to apply the above-described four proposed systems constructed from the standpoint of the optimum control of an actual rolling process, there are the problems that the control system is apt to be affected by the influence of noise of the detection signal because there are many feedback loops, that it takes much time for adjustment of the control gain, and that the control with respect to the rolling process characteristic change followed by the rolling speed change must be adjusted.

Further, the conventional looper control system only considers the rotational speed of the main motor in determining the optimum gain. However, because of roll gap correction operation by the automatic gage control (AGC), a sudden change in the tension would occur, resulting in the possibility that an extreme tension may take place. However, any effective action is not taken in the conventional system.

In addition, an effectively functioning angular range exists in the looper. That is, when a looper angle exceeds above a predetermined angle, there is the possibility that the looper may be broken. In contrast, when the looper angle is below the predetermined angle, the looper cannot entirely conduct the adjustment of the tension. Accordingly, it is necessary to operate the looper within a fixed allowable range with respect to the looper angle. However, any effective action is also not taken in this respect in the conventional system.

SUMMARY OF THE INVENTION

Accordingly, an object of this invention is to provide a looper control system for a continuous rolling mill which is simple from the viewpoint of optimum control and has the function of compensating for various rolling process characteristic changes so that the control system conforms with implementation of the actual process.

Another object of this invention is to provide a looper control system for a continuous rolling mill capable of effectively controlling the looper at all times.

In accordance with this invention, there is provided a looper control system for a continuous rolling mill comprising: a section for performing the integral operation of respective deviations between actual measured values and target values with respect to the tension and the looper angle, and the proportional operation of respective deviations between the tension, the looper operation angle, and the rotational speed of the looper motor at the time of start of control and those at the present control period to synthesize values thus obtained to deliver them to the looper current control unit or the looper control unit, a section for performing the integral operation and the proportional operation similar to the above to synthesize the values thus obtained to deliver them to the main motor speed control unit; an optimum gain setting unit for correcting respective proportional gains in dependency upon the speed of the main motor.

In accordance with this invention, there is also provided a looper control system for a continuous rolling mill comprising: a section for performing the integral operation of respective deviations between actual measured values and target values with respect to the tension and the looper angle, and the proportional operation of respective deviations between the tension, the looper operation angle, and the rotational speed of the looper motor at the time of start of control and those at the present control period to synthesize values thus obtained to deliver them to the looper current control unit or the looper control unit, a section for performing the integral operation and the proportional operation similar to the above to synthesize the values thus obtained to deliver them to the main motor speed control unit; an optimum gain setting unit for correcting respective proportional gains in dependency upon the speed of the main motor; and a section for altering the optimum gain by the fact that the tension and/or the looper angle are extreme.

This invention employs a scheme to construct state vectors required for optimum control from only the respective measured signals of the looper operational angle, the tension between stands, and the looper drive motor speed to thereby hold down the number of feedback loops to a small value. Accordingly, the control system has a little possibility of undergoing the influence of noise in the detection signal, and the number of control gains to be adjusted is smaller than that for the prior art. For this reason, the configuration of the control system is simplified and it is sufficient that the time required for adjustment of the control gain be extremely short. Moreover, since the number of feedback loops is small, the control system has a little possibility of undergoing the influence of noise in the detection signals. Further, since the deviation from the lock-on value is used instead of the deviation from the steady state value in carrying out the proportional operation, the stability in control at the time of start of the control is excellent. Furthermore, setting of the optimum control gain for the rolling process characteristic change followed by the rolling speed change is made, thereby permitting the control system to respond at a high speed at all times irrespective of the rolling speed.

Further, since this invention also detects the extreme tension state and the extreme looper angle state to effectively take a measure, the high rolling quality can be maintained.

In addition, since an approach is employed to calculate and store the integral gain and the proportional gain at the two rolling speeds, e.g., at the threading speed and at the time of the rolling maximum speed using rolling information such as rolling schedule, etc. determined in advance before a material to be rolled reaches the continuous rolling mill in order to carry out compensation of the control gain with respect to the rolling process characteristic change followed by the rolling speed change, to thus set a linearly interpolated integral gain and proportional gain using the speed target value and the actual measured value of the main motor during rolling, this control system has little possibility of undergoing the influence of the rolling process characteristic change.

BRIEF DESCRIPTION OF THE DRAWINGS

In the accompanying drawings:

FIGS. 3A to 3L are graphs showing the operations of the looper control system according to this invention at the time when the tension is in an extreme state, respectively;

FIGS. 4A to 4L are graphs showing the operations of the looper control system according to this invention at the time when the looper angle is in an extreme state.

DESCRIPTION OF THE PREFERRED EMBODIMENTS

Figure 1:
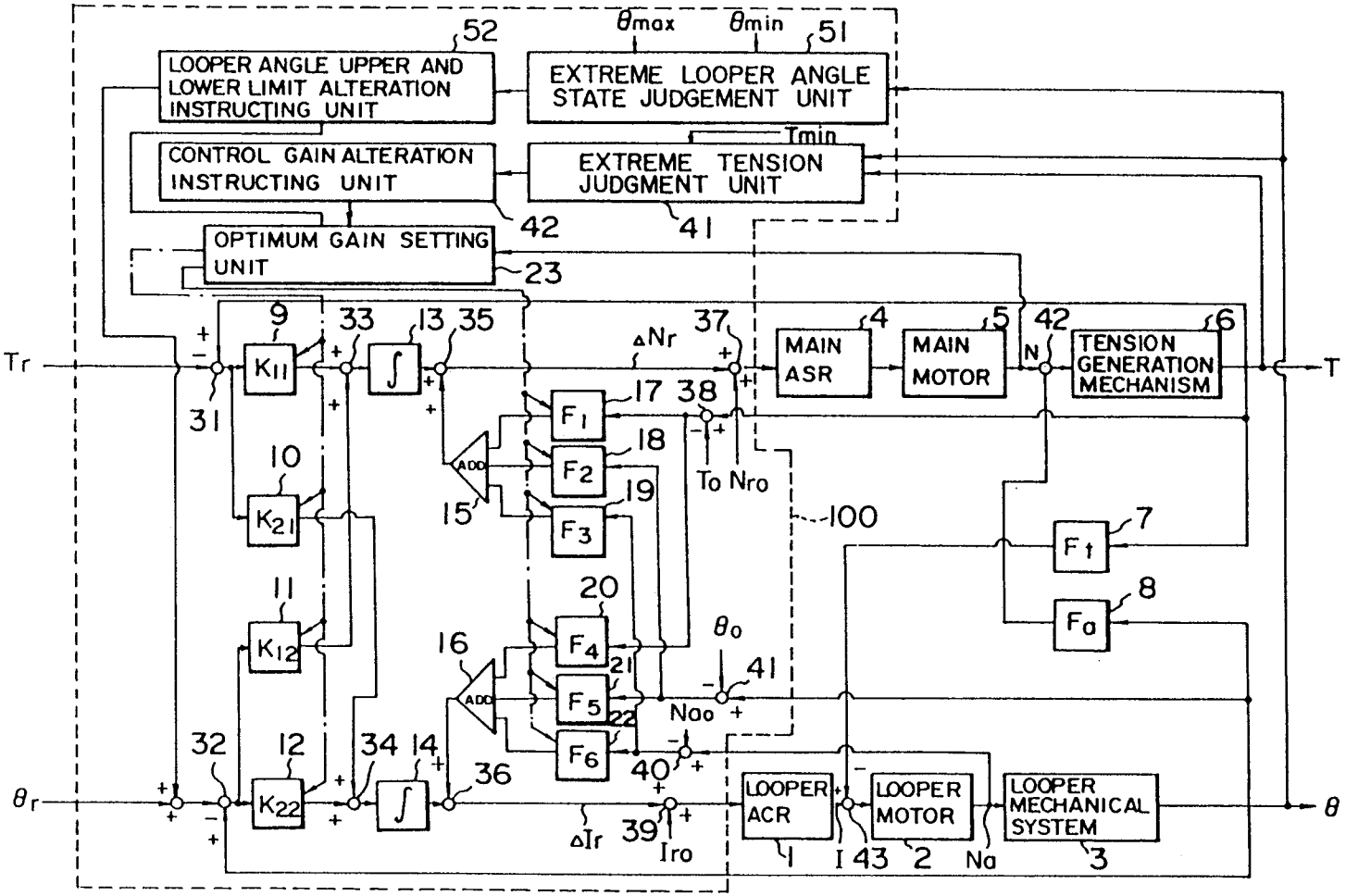
FIG. 1 is a block diagram showing a first embodiment of a looper control system according to this invention.
Figure 2A:
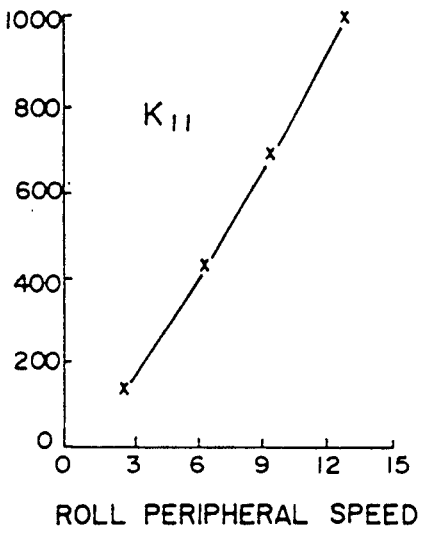
FIGS. 2A to 2J are graphs showing the relationships between the rolling speed and control gains, respectively.
Figure 2B:
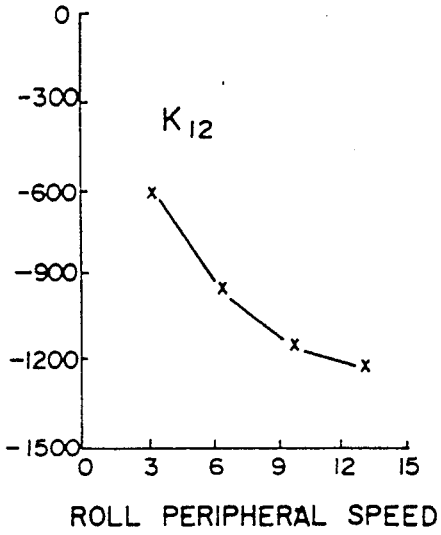
Figure 2C:
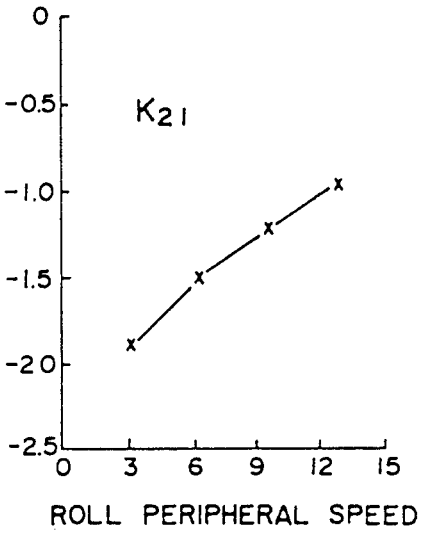
Figure 2D:
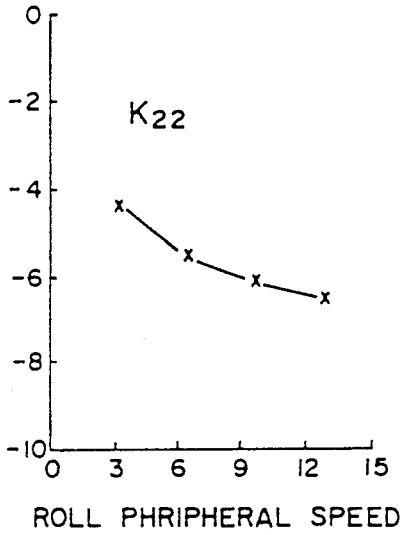
Figure 2E:
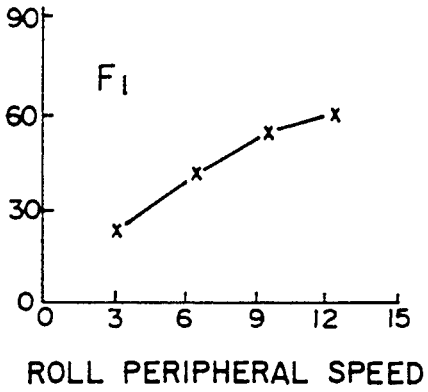
Figure 2F:
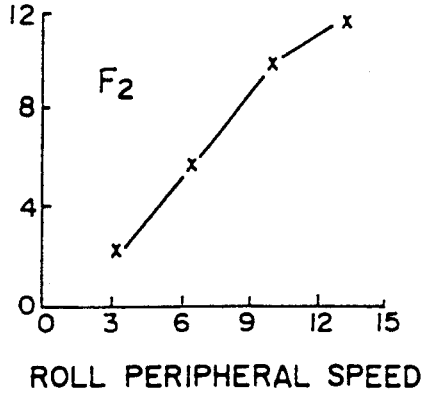
Figure 2G:
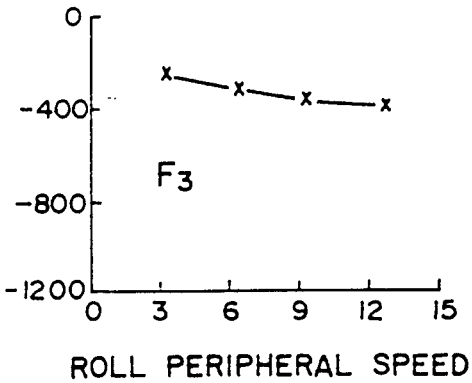
Figure 2H:
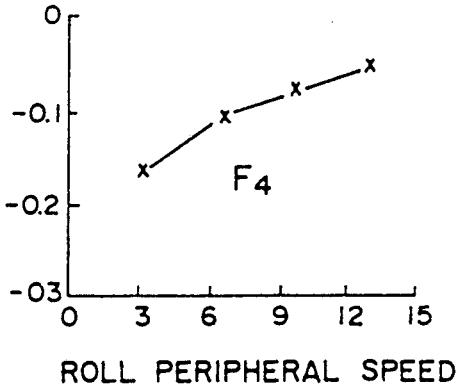
Figure 2I:
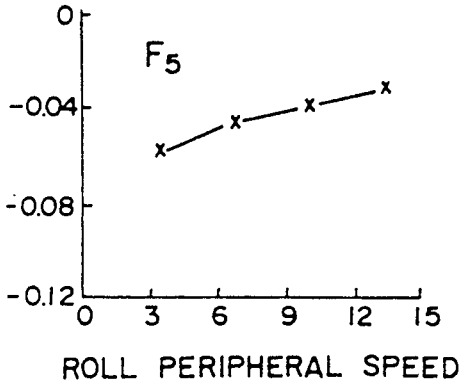
Figure 2J:
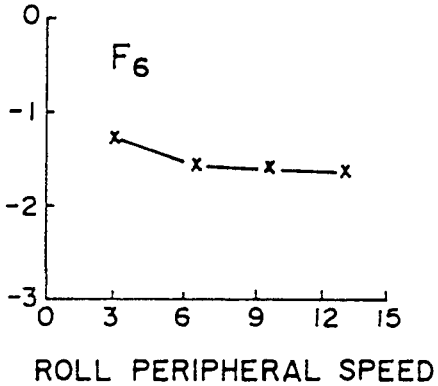

FIG. 1 is a block diagram showing an embodiment of this invention. In FIG. 1, a looper current control unit (looper ACR) 1 controls a looper armature current I flowing in a looper drive motor 2 to thereby drive a looper mechanical system 3. Since the arrangement and the function of the looper mechanism itself is well known, the general description thereof is omitted here.

On the other hand, a main speed control unit (main motor ASR) 4 controls the rotational speed of a main motor 5 for driving the rolling roll. An interstand tension generation mechanism 6 generates an interstand tension T on the basis of a rotational speed N of the main motor, in other words, expresses a transfer function from the rotational speed N to the interstand tension T. This transfer function is determined by the mechanical dimensions and the size of a material subject to rolling of the rolling mill. Further, $F_t$ in a block 7 represents a coefficient for converting an interstand tension T to a looper motor load current and its value is determined by the size of a material subject to rolling and a looper operational angle $\theta$, etc. In addition, $F_a$ in block 8 represents a change in the looper operational angle $\theta$ to a rotational speed of the main motor and its value is determined by the mechanical dimensions of the rolling mill and a looper operational angle. These blocks 7 and 8 are blocks indicating the interference between the looper operational angle $\theta$ and the interstand tension T.

As seen from the above, the blocks 1 to 8 are blocks that express the equipment condition and the rolling process. With such a configuration, the actual interstand tension value T and the looper operational angle $\theta$ are controlled so that they become equal to the interstand tension target value $T_r$ and the looper operational angle target value $\theta_r$, respectively. In addition to the configuration, a looper control unit 100 is provided on the preceding side of the main motor ASR and the looper ACR.

The interstand tension target value $T_r$ is subtracted from the actual interstand tension value T at a subtracter 31. The subtracted result is delivered to an integrator 13 via the block 9 indicative of the integral operation gain $K_{11}$ and an adder 33, and is, on the other hand, delivered to the integrator 14 via the block 10 indicative of the integral operation gain $K_{21}$ and an adder 34.

The looper operation target value $\theta_r$ is subtracted from the actual looper operational angle value $\theta$ at a subtracter 32. The subtracted result is delivered to the integrator 14 via the block 12 indicative of the integrating operation control gain $K_{22}$ and the adder 34, and is, on the other hand, delivered to the integrator 13 via the block 11 indicative of the integral operation control gain $K_{12}$ and the adder 33.

The interstand tension lock on value $T_o$ is subtracted from the actual interstand tension value T at a subtracter 38. The subtracted result is delivered to an adder 15 via a block 17 having a proportional gain $F_1$, and is delivered to an adder 16 via a block 20 having a proportional gain $F_4$. It is to be noted that the lock-on value denotes a value stored at the time of start of control. The looper operation angle lock on value $\theta_o$ is subtracted from the actual looper operation angle value $\theta$ at a subtracter 41. The subtracted result is delivered to the adder 15 via a block 18 having proportional gain $F_2$, and is delivered to the adder 16 via a block 21 having a proportional gain $F_5$. Further, the looper drive motor rotational speed lock-on value $N_{ao}$ is subtracted from the actual rotational speed value $N_a$ of the looper drive motor 2 at a subtracter 40. The subtracted result is delivered to an adder 151 via a block 19 having a proportional gain $F_3$ and is also delivered to the adder 16 via a block 22 having a proportional gain $F_6$.

The added result in the adder 15 is further added to the output of the integrator 13 at an adder 35, resulting in a rotational speed target correction value $\Delta N_r$. A rotational speed target value $N_{ro}$ of the main motor at the time of start of control is added to the above-mentioned correction quantity $\Delta N_r$ at an adder 37. The value thus obtained is delivered to the main motor speed control unit 4 as a rotational speed target value.

On the other hand, the added result in the adder 16 is further added to the output from the integrator 14 a an adder 36, resulting in a looper current target correction quantity $\Delta I_r$. Further, a looper current target value $I_{ro}$ at the time of start of control is added to the above-mentioned value $\Delta I_r$. The value thus obtained is delivered to the looper current control unit I as a looper current target value.

The rotational speed result value of the main motor 5 is taken out and is then inputted to the optimum gain setting unit 23.

This system further comprises an extreme tension state judgement unit 45 for inputting a detected tension T and a looper detected angle $\theta$ to compare the detected tension T with an extreme tension state start tension $T_{min}$, thus to detect an extreme tension state, a control gain alteration instructing unit 46 for instructing alteration of the control gain on the basis of an output from the extreme tension state judgement unit 45, an extreme looper angle state judgement unit 51 for inputting a looper detected angle $\theta$ to compare it with the given maximum looper angle $\theta_{max}$ and the given minimum looper angle $\theta_{min}$ to judge whether or not the looper angle is in an extreme state, and a looper angle upper and lower limit alteration instructing unit 52 for inputting a judged result outputted from the extreme looper angle state judgement unit to alter the upper and lower limits of the looper angle. An output from the looper angle upper and lower limit alteration instructing unit 52 is delivered to the optimum gain setting unit 23, and is added to the looper operation target value $\theta_r$.

In the optimum gain setting unit 23, while monitoring the extreme tension state and the extreme looper angle state, modification or correction of the integral constants $K_{11}$, $K_{21}$, $K_{12}$, $K_{22}$ and the proportional constants $F_1$, $F_2$, $F_3$, $F_4$, $F_5$, $F_6$ is made in dependency upon changes in the rotational speed N of the main motor. Thus, modified results are delivered to integral constant block 9 to 12 and proportional constant blocks 17 to 22, respectively.

Putting the above in order, it will be seen that the looper current target value correction quantity $\Delta I_r$ delivered to the looper current control unit 1 in the looper control system according to this invention is obtained by adding output values from respective means shown below by the items (a) to (c).

(a) Means for performing the integral operation by the integral gain $K_{21}$ (block 10) and the integrator 14 with respect to a deviation between the actual interstand tension value T and the interstand tension target value $T_r$ and the proportional operation by the proportional gain $F_4$ (block 20) with respect to a deviation between the actual interstand tension value T and the interstand tension lock-on value $T_o$, (b) Means for performing the integral operation by the integral gain $K_{22}$ (block 12) and the integrator 14 with respect to a deviation between the actual looper operation angle value $\theta$ and the looper operation angle target value $\theta_r$ and the proportional operation by the proportional gain $F_5$ (block 21) with respect to a deviation between the actual looper operation angle value $\theta$ and the looper operation angle lock on value $\theta_o$, and (c) Means for performing the proportional operation by the proportional gain $F_6$ (block 22) with respect to the actual looper drive motor rotational speed value $N_a$ and the looper drive motor rotational speed lock-on value $N_{ao}$.

The looper current target value correction quantity $\Delta I_r$ thus obtained and the looper current target value $I_{ro}$ at the time of start of control are added. The added result is delivered as a looper current target value to the looper current control unit 1.

On the other hand, a rotational speed target value correction quantity $\Delta N_r$ delivered to the main speed control unit 4 is provided by adding output values of the respective means indicated by the following items (d) to (f).

(d) Means for performing the integral operation by the integral gain $K_{11}$ (block 9) and the integrator 13 With respect to a deviation between the actual interstand tension value T and the interstand tension target value $T_r$ and the proportional operation by the proportional gain $F_1$ (block 17) with respect to a deviation between the actual interstand tension value T and the interstand tension lock on value $T_o$, (e) Means for performing the integral operation by the integral gain $K_{12}$ (block 11) and the integrator 13 with respect to a deviation between the looper operation angle result value $\theta$ and the looper operation angle target value $\theta_r$ and the proportional operation by the proportional gain $F_2$ (block 18) with respect to a deviation between the actual looper operation angle value $\theta$ the looper operation angle target value $\theta_r$ and the proportional operation by the proportional gain $F_2$ (block 18) with respect to a deviation between the actual looper operation angle value $\theta$ and the looper operation angle lock on value $\theta_o$, and (f) Means for performing proportional operation by the proportional gain $F_3$ (block 19) with respect to a deviation between the actual looper drive motor rotational speed value $N_a$ and the looper drive motor rotational speed lock on value $N_{ao}$.

The rotational speed target value correction quantity $\Delta N_r$ of the main motor thus obtained and the rotational speed target value $N_{ro}$ of the main motor at the time of start of control are added. The added result is delivered as a rotational speed target value to the main speed control unit 4.

The operation of the looper control system constructed as described above will now be described.

The looper characteristic model of the continuous rolling mill is considered a non-linear model. When this is subjected to Taylor expansion in the vicinity of a certain steady state and is expressed in the form of the linear state equation, it is expressed by the following equations (1) and (2)

$$x = A.x + B.u \tag{1}$$

$$y = C.x \tag{2}$$

where x denotes a time derivative dx/dt, and x, u and y are vectors represented by the following equations (3), (4) and (5), respectively. Further, A, B and C are 3×3, 3×2, 2×3 constant matrices, respectively.

$$x = [\Delta T, \Delta\theta, \Delta N_a]^T \text{ (state vector)} \tag{3}$$

$$u = [\Delta N_r, \Delta I_r]^T \text{ (manipulated vector)} \tag{4}$$

$$y = [\Delta T, \Delta\theta]^T \text{ (output vector)} \tag{5}$$

where symbol T represents transposition of vector, and symbol Δ represents a deviation from the vicinity of the steady state. Further, notation is given as follows:

T: actual interstand tension value, $\theta$: actual looper operation angle value, $N_a$: actual looper driving motor rotational speed value, $N_r$: rotational speed target value of the main motor, $I_r$: looper current target value.

It is to be noted that the reason why the actual rotational speed value of the main motor and the actual looper current value are not included in the above-described linear state equation is that the models of the main motor speed control unit and the looper current control unit are omitted for realizing simplification of the model to prepare the linear state equation on the assumption that dynamic characteristics of both the main motor speed control and the looper current control can be ignored because of their quick response.

To apply the optimum control theory, vectors x, u as described below are introduced.

$$x = [(y - y_r)^T, x^T]^T \tag{6}$$

$$u = u \tag{7}$$

In the above equation (6), $y_r$ is a target value vector with respect to the output vector expressed by the equation (5). Further, the equations (6) and (7) represent changes in time of the state variable and controlled variable, respectively.

As the state equation with respect to x, u, the following equations are obtained.

$$x = A.x + B.u \tag{8}$$

$$A = \begin{array}{c} \begin{array}{cc} 2 & 3 \end{array} \\ \begin{pmatrix} O & C \\ O & A \end{pmatrix} \begin{array}{l} \}2 \\ \}3 \end{array} \end{array}, \quad B = \begin{array}{c} 2 \\ \begin{pmatrix} O \\ B \end{pmatrix} \end{array} \begin{array}{l} \}2 \\ \}3 \end{array} \tag{9}$$

The object of the looper control is to suppress to as small as possible, a deviation from the target value of the interstand tension, a deviation from the target value of the looper operation angle, and a change in the rolling process. Such a problem is said to be the integral type optimum regulator problem. This problem is formulated as the problem to minimize the phosphometric function.

$$J = \int_0^{\infty} (x^T \cdot \theta \cdot x^T + u^T \cdot R \cdot u) \cdot dt \tag{10}$$

where Q, R are weight coefficient matrices of 5×5 and 2×2 matrices, respectively.

The optimum control rule to minimize the equation (10) is given by the following equation:

$$u = -R^{-1}.B^T.P.x \tag{11}$$

where P is 5×5 matrix, and is a semi-correct solution which satisfies the following Riccati equation.

$$P.A + A^T.P - P.B.R^{-1}.B^T.P + \theta = O \tag{12}$$

It is assumed that P is split as follows:

$$P = \begin{array}{c} \begin{array}{cc} 2 & 3 \end{array} \\ \begin{pmatrix} P_{11} & P_{12} \\ P_{21} & P_{22} \end{pmatrix} \begin{array}{l} \}2 \\ \}3 \end{array} \end{array} \tag{13}$$

On this premise, the above-mentioned equation (11) is rewritten as follows.

$$u = -R^{-1}.B^T.P_{21}.(y - y_r) - R^{-1}.B^T.P_{22}.x \tag{14}$$

Since it is seen from the equation (7) that the actual manipulated vector u is obtained by integrating u, this vector is expressed as follows:

$$\begin{aligned} u &= \int_0^t u \cdot dt + u_0 \\ &= K \cdot \int_0^t (y_r - y) \cdot dt + F \cdot \{x - x_0\} + u_0 \end{aligned} \tag{15}$$

where $x_o$ and $u_o$ are values at the time of start of control of x and u, respectively. Further, K is 2×2 integral gain matrix, and F is 2×3 proportional gain matrix. These matrices are expressed as follows:

$$K = R^{-1} \cdot B^T \cdot P_{21} = \begin{pmatrix} K_{11} & K_{12} \\ K_{21} & K_{22} \end{pmatrix} \quad (16)$$

$$F = R^{-1} \cdot B^T \cdot P_{22} = \begin{pmatrix} F_1 & F_2 & F_3 \\ F_4 & F_5 & F_6 \end{pmatrix} \quad (17)$$

$K_{11}$, $K_{12}$, $K_{21}$, $K_{22}$ of the equation (16) represent integral gains in FIG. 1, and $F_1$, $F_2$, $F_3$, $F_4$, $F_5$, $F_6$ represent proportional gains in FIG. 1, respectively.

In this case, vectors x, u, y represent vectors indicative of deviations from the steady state values $X_s$, $U_s$, $Y_s$ of the set values, respectively. Accordingly, the equation (15) is expressed by the relative value. However, since it is difficult in actual terms to know in advance the steady state value, it is required to rewrite the equation (15) so that this equation is expressed by the absolute value.

Expressing the absolute value vectors corresponding to the vectors x, u, y by x, u, y gives $$X=x+X_x,\ U=u+U_s,\ Y=y+Y_2,\ Y_r=y_r+Y_s, \quad (18)$$

Accordingly, the optimum control rule expressed by the absolute value is given by the following equation:

$$\begin{aligned} U &= u + U_s \\ &= K \cdot \int_0^t \{(y_r - Y_s) - (y + Y_s)\} \cdot dt + \\ &\quad F \cdot \{(x + X_s) - (x_0 + X_s)\} \cdot u_0 + U_s \\ &= K \cdot \int_0^t (Y_r - Y) \cdot dt + F \cdot \{X - X_0\} + U_0 \end{aligned} \quad (19)$$

The correspondence between the equation (19) and FIG. 1 has already expressed by the equations (16) and (17) in regard to the variables K and F. The correspondence relationships with regard to other variables are expressed as follows:

$$U=[N_{ro}+\Delta N_r,\ I_{ro}+\Delta I_r]^T \quad (20)$$

$$U_o=[N_{ro},\ I_{ro}]^T \quad (21)$$

$$Y=[T,\ \theta]^T \quad (22)$$

$$Y_r=[T_r,\ \theta_r]^T \quad (23)$$

$$X=[T,\ \theta,\ N_a]^T \quad (24)$$

$$X_o=[T_o,\ \theta_o,\ N_{ao}]^T \quad (25)$$

As is clear from the equation (19), in accordance with this invention, since the steady state values $X_s$, $U_s$, $Y_s$ are eliminated in actually conducting a control, it is unnecessary to know their values. If lock on values $X_o$, $U_o$ and a target value $Y_r$ are instead given, this is sufficient for execution of a desired control. Further, since the element of the state vector is limited to three kinds of signals, the configuration of the control system becomes simplified.

The operations of the integral/proportional operation units of this invention have been described above. The operation of the optimum gain setting unit (the optimum gain setting unit 23 in FIG. 1) will now be described.

The optimum gain setting unit 23 takes thereinto as its input an actual rotational speed value N of the main motor, thus to set integral gains $K_{11}$, $K_{12}$, $K_{21}$, $K_{22}$ and $F_1$ to $F_6$. This optimum gain setting unit 23 calculates, by using the above-described equations (12), (13), (16) and (17), a gain at an ordinary threading speed and a gain at the rolling maximum speed from rolling information such as a rolling schedule, etc., at the time when the gain before a material subject to rolling reaches the continuous rolling mill, is calculated, e.g., at the time when the material detector provided on the upstream side of the continuous rolling mill detects the material subject to rolling, thus to store them into a memory area (not shown). It is now assumed that the integral gains at the ordinary threading speed to are represented by $K_{11A}$, $K_{12A}$, $K_{21A}$, $K_{22A}$ and the proportional gains thereat are represented by $F_{1A}$ to $F_{6A}$, respectively. Further, the integral gains at the rolling maximum speed are represented by $K_{11B}$, $K_{12B}$, $K_{21B}$, $K_{22B}$ and the proportional gains are represented by $F_{1B}$ to $F_{6B}$, respectively.

The integral gain at an arbitrary time when a material to be rolled is subjected to rolling by the continuous rolling mill is provided by the following equation (26).

$$K_{ij} = (K_{ijB} - K_{ijA}) \cdot (N - N_A)/(N_B - N_a) + K_{ijA} \quad (i = 1, 2\ j = 1, 2) \quad (26)$$

where

N: actual rotational speed value of the main motor, $N_A$: rotational speed set value of the main motor at the ordinary threading time, and $N_B$: rotational speed set value of the main motor at the time of rolling maximum speed.

Further, the proportional gain is provided by the following equation (27) in accordance with the linear interpolation in the same manner as in the case of the equation (26).

$$F_K = (F_{KB} - F_{KA}) \cdot (N - N_A)/(N_B - N_A) + F_{KA} \quad [K = 1, 2, \ldots, 6] \quad (27)$$

FIG. 2 is graph for explaining the relationship between the roll peripheral speed, i.e., the rolling speed and various control gains. From these examples of gain calculation, it is clear that sufficiently practical approximate values are obtained by linear interpolation in connection with all the gains. For a time period during which a material to be rolled is subjected to rolling, an optimum gain is set in accordance with the equations (26) and (27) in the optimum gain setting unit 23, whereby a rotational target value correction quantity $\Delta N_r$ and a looper current target value correction quantity $\Delta I_r$ of the main motor are determined. The rotational speed N of the main motor 5 and the current I of the looper current control unit 1 are modified so that they follow these correction quantities. Thus, the tension T and the looper operatioon angle $\theta$ are controlled so that they are in correspondence with their target values.

Further, a rotational speed setting value of the main motor may be taken as the input to the optimum gain setting unit 23 in place of the actual rotational speed value of the main motor as in the above-described embodiment.

The operation at the time when the tension is in an extreme state will now be described. As previously described, the extreme tension state judgement unit 45 sends a signal indicating that the tension is in an extreme, state to the control gain alteration instructing unit 46. The control gain alteration instructing unit 46 outputs a control gain alteration instruction to the optimum gain setting unit 23 on the basis of the signal indicating that the tension is in an extreme state.

The optimum gain setting unit 23 alters the integral gains $K_{11}$, $K_{12}$, $K_{21}$, $K_{22}$ of the blocks 9 to 12 and the proportional gains $F_1$ to $F_6$ of the blocks 17 to 22 to tension compensation gains set in advance, respectively. If the tension returns to a normal value, the extreme tension state judgement unit 45 stops outputting the signal indicating that the tension is in an extreme state.

The operation at the time when the tension is in an extreme state of the looper control system 100 shown in FIG. 1 will now be described with reference to FIGS. 3A to 3L. FIG. 3A is a graph showing how the tension of a material subject to rolling varies with time where $T_r$ represents a target tension and $T_{min}$ represents a tension set in advance where an extreme state of the tension initially appears. FIG. 3B is a graph showing how the looper angle $\theta$ varies with time where $\theta_r$ represents a target angle, and $\theta_{end}$ represents a tension compensation end angle set in advance ($\theta_r$ and $\theta_{end}$ are set to the same value in this figure). FIGS. 3C to 3F are graphs how the absolute values of the integral gains $K_{11}$, $K_{12}$, $K_{21}$, $K_{22}$ vary with time, respectively, and FIGS. 3G to 3L are graphs how the absolute values of the proportional gains $F_1$ to $F_6$ vary with time, respectively. It is to be noted that these FIGS. 3G to 3L are plotted with respect to the same abscissa showing lapse of time. The timing $T_1$ on the abscissa indicates the time point when a material subject to rolling is chucked into the upstream stand, and the timing $T_2$ indicates the time point when that material is chucked into the downstream stand. At this timing $T_2$, a tension is produced in the material subject to rolling. At times subsequent thereto, the tension and the looper angle are controlled by the looper control system so that there are in correspondence with target values $T_r$, $\theta_r$, respectively. The timing $T_3$ indicates the time point when the tension of a material subject to rolling lowers for any reason and reaches a value lower than the extreme tension $T_{min}$. At the time point $T_3$, a signal indicating that the tension is in an extreme state is transmitted from the extreme tension state judgement unit 45 to the control gain alteration instructing unit 46. Further, a control gain alteration instruction is transmitted to the optimum gain setting unit 23, and the integral gains $K_{11}$, $K_{12}$, $K_{21}$, $K_{22}$ and the proportional gains $F_1$ to $F_6$ are altered to tension compensation gains set in advance. The time point $T_4$ indicates the time point when the looper angle becomes equal to a value lower than the extreme tension end angle $\theta_{end}$ set in advance. Since the extreme tension state judgement unit 45 stops outputting an extreme tension state signal at the time point $T_4$, the control gain alteration instructing output from the control gain alteration instructing unit 46 is also stopped. The optimum gain setting unit 23 returns the gains of the integral operation element and the proportional operation element to original values from the tension compensation gain. Here, the tension compensation gain may be determined by alterating, e.g., weight matrices R, Q of the equation (7) to swing the looper to an extreme extent to calculate such a gain to eliminate a change in the tension. In this case, attention should be drawn to the fact that when such a gain is set in an ordinary rolling state, the looper may be frequently lowered to a level below the pass line, or reach the mechanical upper or lower limits, resulting in a damaged working stability.

The operation of the system according to this invention at the time when the tension is in an extreme state will now be described.

The extreme looper angle state judgement unit 51 judges the looper angle to be extreme for a time period from the time when a detection value $\theta$ of the looper angle exceeds above an upper limit angle $\theta_{max}$ set in advance until it falls below the upper limit angle to output an extreme angle state signal to the looper angle upper and lower limit alteration instructing unit 52. When the looper angle upper and lower alteration instructing unit 52 receives the extreme angle state signal, it alters the target value $\theta_r$ of the looper angle to the upper limit angle and outputs a control gain alteration instruction to the optimum gain setting unit 23. Thus, the optimum gain setting unit 23 alters the integral gains $K_{11}$, $K_{12}$, $K_{21}$, $K_{22}$ of the blocks 9 to 12 and the proportional gains $F_1$ to $F_6$ of the blocks 17 to 22 to the upper limit compensation gains, respectively. When the detection value $\theta$ of the looper angle shifts from the state where it is above the upper limit $\theta_{max}$ to the state where it is less than the upper limit angle $\theta_{max}$, the extreme looper angle judgement unit 45 stops outputting the extreme angle state signal. Thus, the looper angle upper and lower limit alteration instructing unit 52 returns the target value of the looper angle from the upper limit angle $\theta_{max}$ to the original value to turn off the control gain alteration instruction which has been outputted to the optimum gain setting unit 23. Accordingly, the optimum gain setting unit 23 returns the integral gains of the blocks 9 to 12 and the proportional gain of the blocks 17 to 22 from the upper limit angle compensation gains to the original values, respectively.

Similarly, the abnormal looper angle state judgement unit 51 judges the looper angle to be abnormal for a time period from the time when a detection value $\theta$ of the looper angle falls below the lower limit $\theta_{min}$ until it exceeds above the lower limit angle $\theta_{min}$ to output an abnormal angle state signal to the looper upper and lower limit alteration instructing unit 52. Thus, the looper angle upper and lower limit alteration instructing unit 52 alters the target value $\theta_r$ of the looper angle to the lower limit angle $\theta_{min}$ and outputs a control gain alteration instruction to the optimum gain setting unit 23. Thus, the optimum gain setting unit 23 alters the integral gains $K_{11}$, $K_{12}$, $K_{21}$, $K_{22}$ of the blocks 9 to 12 and the proportional gains $F_1$ to $F_6$ of the blocks 17 to 22 to the limit compensation gains for lower limit angle on the basis of the alteration instruction. When a detection value $\theta$ of the looper angle shifts from the state where it is less than the lower limit $\theta_{min}$ to the state where it is above the lower limit $\theta_{min}$, the extreme looper angle state judgement unit stops outputting the extreme angle state signal. Thus, the looper angle upper and lower limit alteration instructing unit 52 returns the target value of the looper angle from the lower limit angle $\theta_{min}$ to the original value to turn off the control gain alteration instruction which has been outputted to the optimum gain setting unit 23. Accordingly, the optimum gain setting unit 23 returns the integral gains of the blocks 9 to 12 and the proportional gains of the blocks 17 to 22 from the limit angle compensation gain to the original values, respectively.

The operation at the time when the looper angle is in an extreme state of the looper control system 100 shown in FIG. 1 will now be described with reference to FIGS. 4A to 4L. FIG. 4A is a graph showing how the target value $\theta_r$ of the looper angle varies with time where $\theta_{aim}$ represents a target angle in the case of conducting an ordinary control, $\theta_{max}$ represents an upper limit set in advance, and $\theta_{min}$ represents a lower limit angle set in advance. FIG. 4B is a graph showing how the looper angle $\theta$ varies with time. FIGS. 4C to 4F are graphs showing how the absolute values of the integral gains $K_{11}$, $K_{12}$, $K_{21}$, $K_{22}$ vary with time, respectively. FIGS. 4G to 4L are graphs showing how the absolute values of the proportional gains $F_1$ to $F_6$ vary with time. These FIGS. 4A to 4L are plotted with respect to the same abscissa showing lapse of time. The timing $T_1$ on the abscissa indicates the time point when a material subject to rolling has been chucked into the upstream stand, and the timing $T_2$ indicates the time point when that material has been chucked into the downstream stand. At the timing $T_2$, a tension is produced in the material subject to rolling. At times subsequent thereto, the tension T and the looper angle $\theta$ are controlled by the looper control system 100 so that they are in correspondence with values near the target values $T_r$ and $\theta_r$, respectively. The timing $T_3$ indicates the time point when the looper angle $\theta$ increases suddenly for any reason to exceed above the upper limit angle $\theta_{max}$. At the timing $T_3$, the extreme looper angle state judgement unit 51 outputs an extreme angle state signal to the angle upper and lower limit alteration instructing unit 52. Thus, the angle upper and lower limit alteration instructing unit 52 alters the target value $\theta_r$ of the looper angle from $\Theta_{aim}$ to the upper limit $\theta_{max}$ and outputs a control gain alteration instruction to the optimum gain setting unit 23. The optimum gain setting unit 23 alters the integral gains $K_{11}$, $K_{12}$, $K_{21}$, $K_{22}$ and the proportional gains $F_1$ to $F_6$ to the respective upper limit angle compensation gains. The timing $T_4$ indicates the time point when the looper angle shifts from the state where it exceeds above the upper limit angle $\theta_{max}$ to the state where it falls below the upper limit angle $\theta_{max}$. Since the extreme looper angle state judgement unit 51 stops an output indicative of extreme angle state at the timing $T_4$, the looper angle upper and lower limit alteration instructing unit 52 returns the target value $\theta_r$ of the looper angle from $\theta_{max}$ to $\theta_{aim}$ and stops the control gain alteration instructing output which has been outputted to the optimum gain setting unit 23. Thus, the optimum gain setting unit 23 returns the integral gains and the proportional gains from the upper limit angle compensation gains for upper limit to the original values, respectively.

Figure 5:
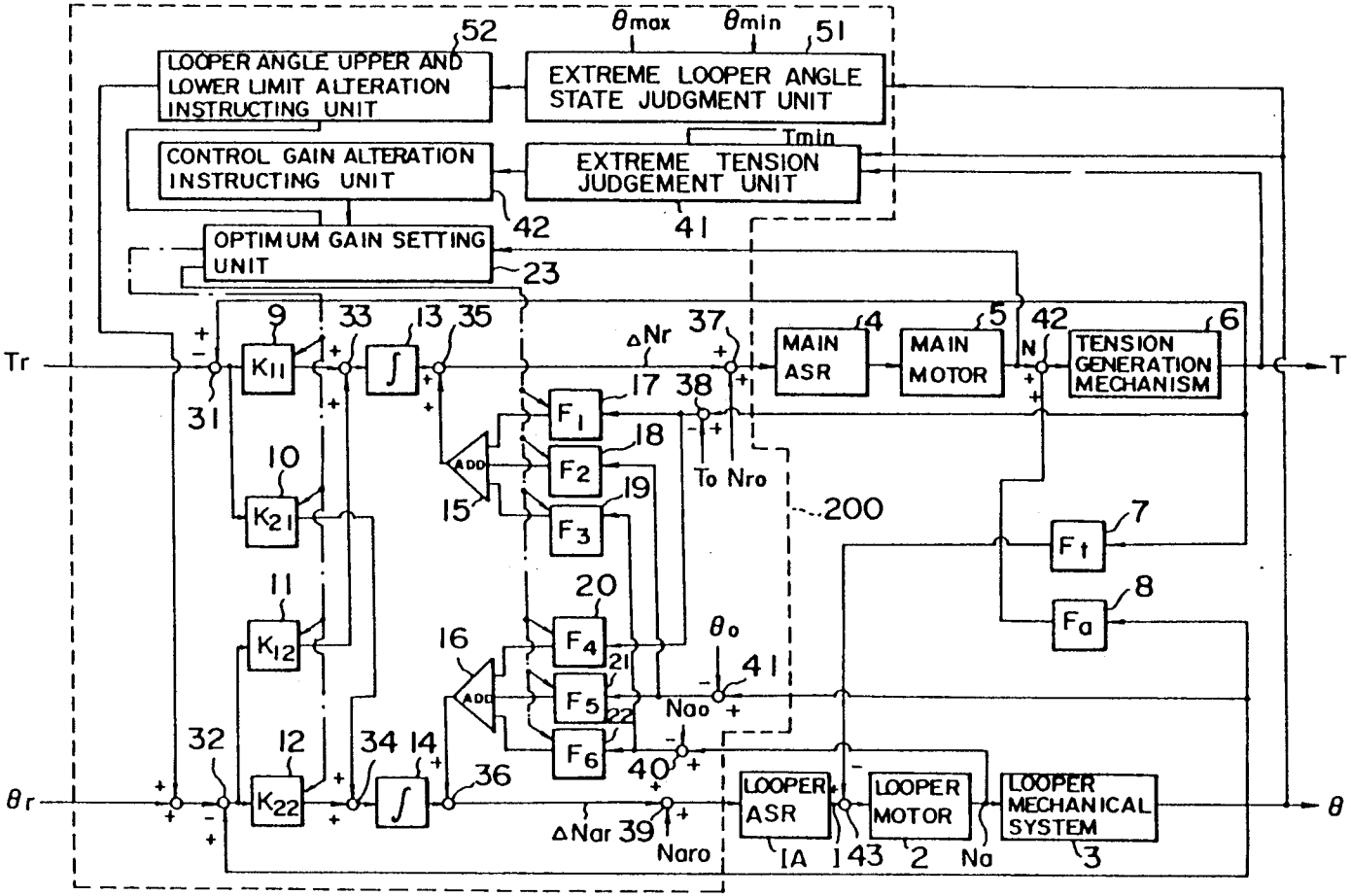
FIG. 5 is a block diagram showing a second embodiment of a looper control system according to this invention.

FIG. 5 is a block diagram showing a second embodiment according to this invention. In this figure, the same components as those in FIG. 1 are designated by the same symbols or reference numerals, respectively, and their explanation will be omitted.

In FIG. 5, a looper speed control unit (looper ASR) 1A is used. This embodiment differs from the embodiment in FIG. 1 in that the above portion was constituted by the looper current control unit in the embodiment in FIG. 1. The looper speed control unit controls a rotational speed $N_a$ of the looper driving motor 2 to drive the looper mechanical system 3. The rotational speed target value for this looper speed control unit is obtained by adding an output from the integrator 14 and an output from the adder 16 at the adder 36 to provide a looper speed target correction quantity $N_{ar}$ to add it to a looper speed target value $N_{aro}$ at the time of start of control at the adder 39.

Since the flows of other signals are completely the same as those in the case of FIG. 1, the detailed explanation is omitted.

Accordingly, when the configuration of the looper control system according to this embodiment is put in order, it is seen that the speed target value correction quantity $\Delta N_{ar}$ delivered to the looper speed control unit 1 is essentially provided by adding output values from the respective means shown in the following items (a) to (c).

(a) Means for performing the integral operation by the integral gain $K_{12}$ (block 10) and the integrator 14 with respect to a deviation between the actual interstand tension value T and the interstand tension target value $T_r$, and the proportional operation by the proportional gain $F_4$ (block 20) with respect to a deviation between the actual interstand tension value T and the interstand tension lock on value $T_o$, (b) Means for performing the integral operation by the integral gain $K_{22}$ (block 12) and the integrator 14 with respect to a deviation between the actual looper operation angle value $\theta$ and the looper operation angle target value $\theta_r$ and the proportional operation by the proportional gain $F_5$ (block 21) in connection with a deviation between the actual looper operation angle value $\theta$ and the looper operation angle lock-on value $\theta_o$, and (c) Means for performing the proportional operation by the proportional gain $F_6$ (block 22) with respect to the actual looper drive motor rotational speed value $N_a$ and the looper drive motor rotational speed lock on value $N_{ao}$.

The looper speed target value correction quantity $\Delta N_{ar}$ thus obtained and the looper speed target value $N_{aro}$ at the time of start of control are added. The added value thus obtained is delivered as a looper current target value to the looper control unit 1A.

On the other hand, the rotational speed target value correction quantity $\Delta N_r$ of the main motor delivered to the main speed control unit 4 is provided by adding output values from the respective means shown in the following items (d) to (f).

(d) Means for performing the integral operation by the integral gain $K_{11}$ (block 9) and the integrator 13 with respect to a deviation between the actual interstand tension value T and the interstand tension target value $T_r$, and the proportional operation by the proportional gain $F_1$ (block 17) with respect to a deviation between the actual interstand tension value T and the interstand tension lock on value $T_o$, (e) Means for performing the integral operation by the integral gain $K_{12}$ (block 11) and the integrator 13 with respect to a deviation between the actual looper operation angle value $\theta$ and the looper operation angle target value $\theta_r$, and the proportional operation by the proportional gain $F_2$ (block 18) with respect to a deviation between the actual looper operation angle value $\theta$ and the looper operation angle lock-on value $\theta_o$, (f) Means for performing the proportional operation by the proportional gain $F_3$ (block 19) with respect to the actual looper drive motor rotational speed value $N_a$ and the looper drive motor rotational speed lock on value $N_{ao}$.

The rotational speed target value correction quantity $\Delta N_r$ of the main motor thus obtained and the rotational speed target value $N_{ro}$ of the main motor at the time of start of control are added. The added value thus obtained is delivered as a rotational speed target value to the main motor speed control unit 5.

Further, in the same manner as in the case of FIG. 1, modifications of the above-mentioned respective integral gains and the proportional gains will be made in accordance with the state where the tension is extreme by the extreme tension state judgement unit 45 and the control gain alteration instructing unit 46; and in accordance with the state where the looper angle is extreme by the extreme looper angle state judgement unit 51 and the looper angle upper and lower limit alteration instructing unit 52.

The operation of the looper control system constructed as described above will now be described.

The looper characteristic model of the continuous rolling mill is represented by the previously described equations (1) and (2) expressed in the form of the linear state equation.

$$x = A.x + B.u \quad (1)$$

$$y = C.x \quad (2)$$

where x means a time derivative dx/dt. x and y are vectors expressed by the equations (3) and (5), respectively, but only the manipulation vector u is different from the above and is expressed by the following equation (28). Further, A, B and C are constant matrices of $3\times3$, $3\times2$ and $2\times3$, respectively.

$$x = [\Delta T, \Delta\theta, \Delta N_a]^T \text{ (state vector} \quad (3)$$

$$u = [\Delta N_r, \Delta N_{ar}]^T \text{ (manipulated vector)} \quad (28)$$

$$y = [\Delta T, \Delta\theta]^T \text{ (output vector)} \quad (5)$$

In the above equation, symbol T represents a transposition of vector and symbol $\Delta$ represents a deviation from the vicinity of the steady state. Further, the notations employed are as follows:

T: actual interstand tension value, $\theta$: actual looper operation angle value, $N_a$: actual looper drive motor rotational speed value, $N_r$: rotational speed target value of the main motor, $N_{ar}$: looper speed target value.

The optimum control theory is applied to this embodiment in exactly the same manner as in the case of FIG. 1, and therefore the previously described equations (6) to (19) are applied.

The correspondences between variables in the equation (19) and FIG. 5 are expressed by the equations (16) and (17) in connection with K, F, respectively, and are expressed by the equations (22), (23), (24) and (15) in connection with Y, $Y_r$, X and $X_o$, respectively. The above-mentioned correspondence are expressed, in connection with U and $U_o$, as follows:

$$U = [N_{ro} + \Delta N_r, N_{aro} + N_{ar}]^T \quad (29)$$

$$U_o = [N_{ro}, N_{aro}]^T \quad (30)$$

Accordingly, also in the embodiment shown in FIG. 5, optimum control can be made by the feedback loop configuration using only three kinds of signals.

It is to be noted that the gain alteration in response to the extreme tension and/or the extreme looper angle can be adopted arbitrarily.

What is claimed is:

1. A looper control system for a continuous rolling mill, including a looper current/speed control unit for controlling a current/rotational speed of a looper driving motor and a main motor speed control unit for controlling a rotational speed of a main motor for driving the roll of a rolling stand adjacent to the looper, said looper control system comprising:

first integral means for performing an integral operation with respect to a deviation between a measured tension value of a material subject to rolling between the stands and a tension target value, first proportional means for performing the proportional operation with respect to a deviation between the measured tension value and a tension detection value at the time of start of the control, second integral means for performing the integral operation with respect to a deviation between a measured looper operation angle value and a looper operation target value, second proportional means for performing the proportional operation with respect to a deviation between the measured looper operation angle value and a measured looper operation angle value at the time of start of the control, third proportional means for performing the proportional operation with respect to a deviation between a measured rotational speed value of said looper driving motor and a value at the time of start of the control, first synthesis means for adding respective outputs from said first and second integral means and from said first to third proportional means to thereby synthesize a current/rotational speed target value correction quantity of said looper current/speed control unit to output it to said looper current/speed control unit, third integral means for performing the integral operation with respect to a deviation between the measured tension value of the material subject to rolling between the stands and a tension target value, fourth proportional means for performing the proportional operation with respect to the measured tension value and a measured tension value at the time of start of the control, fourth integral means for performing the integral operation with respect to a deviation between a measured looper operation angle value and a looper operation angle target value, fifth proportional means for performing the proportional operation with respect to a deviation between the measured looper operation angle value and a measured looper operation angle value at the time of start of the control, sixth proportional means for performing the proportional operation with respect to a deviation between the measured rotational speed value of said looper driving motor and a value at the time of start of the control, second synthesis means for adding respective outputs from said third and fourth integral means and from said fourth to sixth proportional means to thereby synthesize a speed target value correction quantity of said main speed control unit to output it to said main motor speed control unit, and optimum gain setting means for storing gains in said respective integral operations and said respective proportional operations at two rolling speeds or more before said material subject to rolling is subjected to rolling by said continuous rolling mill, thus to set, with respect to said respective integral operations and said respective proportional operations, gains linearly interpolated on the basis of said stored gains using a speed target value and a measured speed value of said main motor during rolling.

2. A looper control system for a continuous rolling mill, including a looper current control unit for controlling an armature current flowing in a looper driving motor and a main motor speed control unit for controlling a rotational speed of a main motor for driving the roll of a rolling stand adjacent to the looper, said looper control system comprising:

first integral means for performing an integral operation with respect to a deviation between a measured tension value of a material subject to rolling between the stands and a tension target value, first proportional means for performing the proportional operation with respect to a deviation between the measured tension value and a tension detection value at the time of start of the control, second integral means for performing the integral operation with respect to a deviation between a measured looper operation angle value and a looper operation target value, second proportional means for performing the proportional operation with respect to a deviation between the measured looper operation angle value and a looper operation angle detection value at the time of start of the control, third proportional means for performing the proportional operation with respect to a deviation between a rotational speed detection value of said looper driving motor and a value at the time of start of the control, first synthesis means for adding respective outputs from said first and second integral means and from said first to third proportional mean to thereby synthesize a current target value correction quantity of said looper current control unit to output it to said looper current control unit, third integral means for performing the integral operation with respect to a deviation between the measured tension value of the material subject to rolling between the stands and a tension target value, fourth proportional means for performing the proportional operation with respect to the tension detection value and a measured tension value at the time of start of the control, fourth integral means for performing the integral operation with respect to a deviation between a measured looper operation angle value and a looper operation angle target value, fifth proportional means for performing the proportional operation with respect to a deviation between the looper operation angle detection value and a looper operation angle detection value at the time of start of the control, sixth proportional means for performing the proportional operation with respect to a deviation between the rotational speed detection value of said looper driving motor and a value at the time of start of the control, second synthesis means for adding respective outputs from said third and fourth integral means and from said fourth to sixth proportional means to thereby synthesize a speed target value correction quantity of said main speed control unit to output it to said main motor speed control unit, optimum gain setting means for storing gains in said respective integral operations and said respective proportional operations at two rolling speeds or more before said material subject to rolling is subjected to rolling by said continuous rolling mill, to thus set, with respect to said respective integral operations and said respective proportional operations, gains linearly interpolated on the basis of said stored gains using a speed target value and a speed result value of said main motor during rolling, extreme tension state judgement means for comparing said tension detection value and said measured looper angle value with a tension value at the time when an abnormal state in tension initially appears to judge whether or not the tension is extreme, control gain alteration instruction means for instructing said optimum gain setting unit to alter said respective gains in accordance with a signal indicating that the tension is extreme, outputted from said extreme tension state judgement means, extreme looper angle state judgement means for comparing said looper angle detected value with a maximum looper angle and a minimum looper angle within in which the looper normally operates, thus to judges whether or not the looper angle is extreme, and looper angle upper and lower limit alteration instructing means (52) for instructing said optimum gain setting unit to alter said respective gains so as to alter the upper and lower limits of the looper angle in dependency upon the signal indicating that the looper angle is extreme, outputted from said extreme looper angle state judgement means, and for altering said looper operation angle target value.

3. A looper control system for a continuous rolling mill, including a looper speed control unit (1A)for controlling a rotational speed of a looper driving motor and a main motor speed control unit for controlling a rotational speed of a main motor for driving the roll of a rolling stand adjacent to the looper, said looper control system comprising:

first integral means for performing an integral operation with respect to a deviation between a measured tension value of a material subject to rolling between the stands and a tension target value, first proportional means for performing the proportional operation with respect to a deviation between the measured tension value and a tension detection value at the time of start of the control, second integral means for performing the integral operation with respect to a deviation between a measured looper operation angle value and a looper operation target value, second proportional means for performing the proportional operation with respect to a deviation between the measured looper operation angle value and a looper operation angle detection value at the time of start of the control, third proportional means for performing the proportional operation with respect to a deviation between a rotational speed detection value of said looper driving motor and a value at the time of start of the control, first synthesis means for adding respective outputs from said first and second integral means and from said first to third proportional means to thereby synthesize a rotational speed target value correction quantity of said looper speed control unit to output it to said looper speed control unit, third integral means for performing the integral operation with respect to a deviation between the measured tension value of the material subject to rolling between the stands and a tension target value, fourth proportional means for performing the proportional operation with respect to the tension detection value and a measured tension value at the time of start of the control, fourth integral means for performing the integral operation with respect to a deviation between a measured looper operation angle value and a looper operation angle target value, fifth proportional means for performing the proportional operation with respect to a deviation between the looper operation angle detection value and a looper operation angle detection value at the time of start of the control, sixth proportional means for performing the proportional operation with respect to a deviation between the rotational speed detection value of said looper driving motor and a value at the time of start of the control, second synthesis means for adding respective outputs from said third and fourth integral means and from said fourth to sixth proportional means to thereby synthesize a speed target value correction quantity of said speed control unit to output it to said main motor speed control unit, optimum gain setting means for storing gains in said respective integral operations and said respective proportional operations at two rolling speeds or more before said material subject to rolling is subjected to rolling by said continuous rolling mill, thus to set, with respect to said respective integral operations and said respective proportional operations, gains linearly interpolated on the basis of said stored gains using a speed target value and a speed result value of said main motor during rolling, extreme tension state judgement means for comparing said tension detection value and said measured looper angle value with a tension value at the time when an abnormal state in tension initially appears to judge whether or not the tension is extreme, control gain alteration instruction means for instructing said optimum gain setting unit to alter said respective gains in accordance with a signal indicating that the tension is extreme, outputted from said extreme tension state judgement means, extreme looper angle state judgement means for comparing said looper angle detected value with a maximum looper angle and a minimum looper angle within in which the looper normally operates, thus to judges whether or not the looper angle is extreme, and looper angle upper and lower limit alteration instructing means (52) for instructing said optimum gain setting unit to alter said respective gains so as to alter the upper and lower limits of the looper angle in dependency upon the signal indicating that the looper angle is extreme, outputted from said extreme looper angle state judgement means, and for altering said looper operation angle target value.

* * * * *